US011710359B2

(12) United States Patent
Einberg et al.

(10) Patent No.: US 11,710,359 B2
(45) Date of Patent: Jul. 25, 2023

(54) MANAGING ACCESS CONTROL TO A PHYSICAL SPACE CONTROLLED BY A LOCK DEVICE

(71) Applicant: ASSA ABLOY AB, Stockholm (SE)

(72) Inventors: Fredrik Einberg, Huddinge (SE); Fredrik Lindersson, Täby (SE)

(73) Assignee: ASSA ABLOY AB, Stockholm (SE)

( * ) Notice: Subject to any disclaimer, the term of this patent is extended or adjusted under 35 U.S.C. 154(b) by 28 days.

(21) Appl. No.: 17/291,894

(22) PCT Filed: Nov. 12, 2019

(86) PCT No.: PCT/EP2019/081039
§ 371 (c)(1),
(2) Date: May 6, 2021

(87) PCT Pub. No.: WO2020/099414
PCT Pub. Date: May 22, 2020

(65) Prior Publication Data

US 2022/0005296 A1 Jan. 6, 2022

(30) Foreign Application Priority Data

Nov. 13, 2018 (EP) ..... 18205859

(51) Int. Cl.
*G07C 9/00* (2020.01)

(52) U.S. Cl.
CPC ..... *G07C 9/00309* (2013.01); *G07C 2209/08* (2013.01); *G07C 2209/63* (2013.01)

(58) Field of Classification Search
None
See application file for complete search history.

(56) References Cited

U.S. PATENT DOCUMENTS 10,431,026 B2 * 10/2019 Berg ..... H04L 63/0853
2014/0013418 A1 * 1/2014 Davis ..... G07C 9/23 726/16

(Continued)

FOREIGN PATENT DOCUMENTS

EP 3073283 9/2016
EP 3467238 4/2019

(Continued)

OTHER PUBLICATIONS

Extended Search Report for European Patent Application No. 18205859.4, dated Apr. 26, 2019, 8 pages.

(Continued)

*Primary Examiner* — Carlos Garcia
(74) *Attorney, Agent, or Firm* — Schwegman Lundberg & Woessner, P.A.

(57) ABSTRACT

It is provided a method for managing access control to a physical space controlled by a first lock device. The method is performed by an access management device, and comprises the steps of: determining whether a mobile credential is located inside or outside a barrier secured by a lock device; storing an inside indicator in association with the mobile credential when it is located on the inside of the barrier, the inside indicator being valid until explicitly cleared; and preventing the mobile credential from establishing a communication channel with the first lock device when a valid inside indicator is stored for the mobile credential.

17 Claims, 4 Drawing Sheets

(56) References Cited

U.S. PATENT DOCUMENTS

| | | | | |
|---|---|---|---|---|
| 2015/0220721 | A1* | 8/2015 | Davis | G06F 21/31 726/20 |
| 2018/0047232 | A1 | 2/2018 | Sakumoto et al. | |
| 2018/0270214 | A1* | 9/2018 | Caterino | G06F 21/35 |
| 2018/0357845 | A1* | 12/2018 | Berg | H04L 63/0876 |

FOREIGN PATENT DOCUMENTS

| | | |
|---|---|---|
| WO | WO 2014/107196 | 7/2014 |
| WO | WO 2017/209030 | 12/2017 |

OTHER PUBLICATIONS

International Search Report and Written Opinion for International (PCT) Patent Application No. PCT/EP2019/081039, dated Feb. 5, 2020, 15 pages.
Second Written Opinion for International (PCT) Patent Application No. PCT/EP2019/081039, dated Oct. 14, 2020, 8 pages.
International Preliminary Report on Patentability for International (PCT) Patent Application No. PCT/EP2019/081039, dated Feb. 19, 2021, 20 pages.

* cited by examiner

MANAGING ACCESS CONTROL TO A PHYSICAL SPACE CONTROLLED BY A LOCK DEVICE

CROSS REFERENCE TO RELATED APPLICATIONS

This application is a national stage application under 35 U.S.C. 371 and claims the benefit of PCI Application No. PCT/EP2019/081039 having an international filing date of Nov. 12, 2019, which designated the United States, which PCT application claimed the benefit of Europe Patent Application No. 18205859.4 filed Nov. 13, 2018, the disclosure of each of which are incorporated herein by reference.

TECHNICAL FIELD

The invention relates to a method, an access control manager, a computer program and a computer program product for managing access control to a physical space controlled by a lock device.

BACKGROUND

Lock devices and key devices are evolving from the traditional pure mechanical locks. These days, there are wireless interfaces for electronic lock devices, e.g. by interacting with a mobile credential. For instance, Radio Frequency Identification (RFID) has been used as the wireless interface. When RFID is used, the user needs to present the mobile credential very close to a reader of the lock.

In order to provide a more user-friendly solution, wireless interfaces, such as Bluetooth Low Energy, BLE, with greater range are starting to be used. This allows the interaction between the mobile credential and the lock device to occur without user interaction, e.g. with a mobile credential being located in a pocket or handbag. However, in such a situation, there is a risk that someone on the inside unlocks the lock device by simply walking by the lock device. In order to prevent this from happening, without introducing user interaction to open the lock device, there needs to be a way to block mobile credentials on the inside from unlocking the lock device.

One way to achieve this is to determine where the mobile credential is located, i.e. inside or outside a barrier. In this way, automatic access control could be disabled for inside devices, preventing inadvertent unlocking.

However, the determination of location is not always 100 percent correct. Hence, when a large number of mobile credentials are considered, over time, there is still a significant risk that a mobile credential on the inside is incorrectly considered to be on the outside, at which point the lock device could be inadvertently unlocked, which can be a security risk

SUMMARY

It is an object to reduce the risk of inadvertent unlocking of a lock device when a mobile credential is on the inside.

According to a first aspect, it is provided a method for managing access control to a first physical space controlled by a first lock device. The method is performed by an access management device, and comprises the steps of: determining whether a mobile credential is located inside or outside a barrier secured by a lock device; storing an inside indicator in association with the mobile credential when it is located on the inside of the barrier, the inside indicator being valid until explicitly cleared; and preventing the mobile credential from establishing a communication channel with the first lock device when a valid inside indicator is stored for the mobile credential.

The access management device may form part of the mobile credential, in which case the step of preventing the mobile credential from establishing a communication channel comprises preventing the mobile credential from sending any signal to the first lock device.

The access management device may form part of the first lock device, in which case the step of preventing the mobile credential from establishing a communication channel comprises rejecting any communication request from the mobile credential.

The method may further comprise the step of: clearing the inside indicator for the mobile credential when the barrier is opened.

The barrier may be determined to be opened by receiving a signal from a barrier sensor that the barrier has been opened.

The method may further comprise the step of: clearing the inside indicator for the mobile credential when a timer expires.

The step of determining whether the mobile credential is located inside or outside may comprise considering the mobile credential to be inside when the mobile credential is in the first physical space.

The step of determining whether the mobile credential is located inside or outside a barrier may comprise considering the mobile credential to be inside when the mobile credential is in the first physical space or in a second physical space secured by a second lock device.

The first physical space may be a first guest room and the second physical space may be a second guest room.

According to a second aspect, it is provided an access management device for managing access control to a first physical space controlled by a first lock device. The access management device comprises: a processor; and a memory storing instructions that, when executed by the processor, cause the access management device to: determine whether a mobile credential is located inside or outside a barrier secured by a lock device; store an inside indicator in association with the mobile credential when it is located on the inside of the barrier, the inside indicator being valid until explicitly cleared; and prevent the mobile credential from establishing a communication channel with the first lock device when a valid inside indicator is stored for the mobile credential.

The access management device may form part of the mobile credential, in which case the instructions to prevent the mobile credential from establishing a communication channel comprise instructions that, when executed by the processor, cause the access management device to prevent the mobile credential from sending any signal to the first lock device.

The access management device may form part of the first lock device, in which case the instructions to prevent the mobile credential from establishing a communication channel comprise instructions that, when executed by the processor, cause the access management device to reject any communication request from the mobile credential.

The access management device may further comprise instructions that, when executed by the processor, cause the access management device to: clear the inside indicator for the mobile credential when the barrier is opened.

The barrier may be determined to be opened by receiving a signal from a barrier sensor that the barrier has been opened.

The access management device may further comprise instructions that, when executed by the processor, cause the access management device to: clear the inside indicator for the mobile credential when a timer expires.

The instructions to determine whether the mobile credential is located inside or outside may comprise instructions that, when executed by the processor, cause the access management device to consider the mobile credential to be inside when the mobile credential is in the first physical space.

The instructions to determine whether the mobile credential is located inside or outside a barrier may comprise instructions that, when executed by the processor, cause the access management device to consider the mobile credential to be inside when the mobile credential is in the first physical space or in a second physical space secured by a second lock device.

The first physical space may be a first guest room and the second physical space may be a second guest room.

According to a third aspect, it is provided a computer program for managing access control to a first physical space controlled by a first lock device. The computer program comprises computer program code which, when run on an access management device causes the access management device to: determine whether a mobile credential is located inside or outside a barrier secured by a lock device; store an inside indicator in association with the mobile credential when it is located on the inside of the barrier, the inside indicator being valid until explicitly cleared; and prevent the mobile credential from establishing a communication channel with the first lock device when a valid inside indicator is stored for the mobile credential.

According to a fourth aspect, it is provided a computer program product comprising a computer program according to the third aspect and a computer readable means on which the computer program is stored.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

Embodiments presented herein are based on preventing communication between a lock device and a mobile credential being located on the inside of a barrier secured by the lock device. More particularly, when the mobile credential is on the inside, this information is saved as an inside indicator and further communication is prevented until the inside indicator is explicitly cleared. In this way, the risk for inadvertent unlocking due to incorrect determination of inside/outside is greatly reduced.

Figure 1:
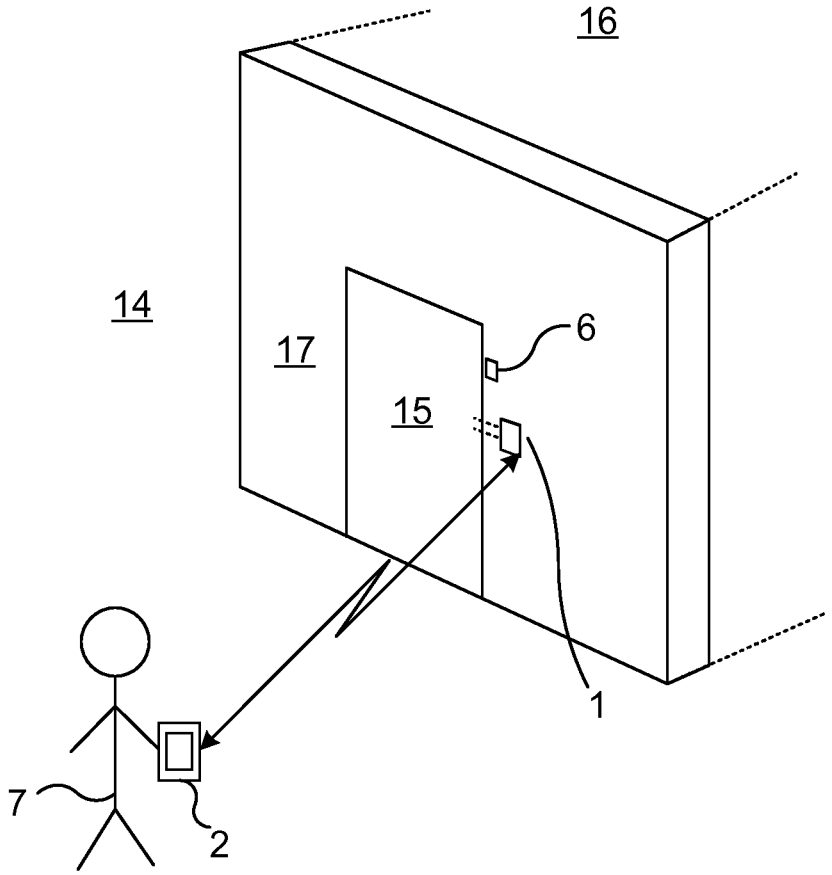
FIG. 1 is a schematic diagram showing an environment in which embodiments presented herein can be applied.

FIG. 1 is a schematic diagram showing an environment in which embodiments presented herein can be applied. Access to a first physical space 16 is restricted by an openable physical barrier 15, which is selectively unlockable. The barrier 15 stands between the restricted first physical space 16 on the inside of the barrier 15 and an accessible physical space 14 on the outside of the barrier 15. Note that the accessible physical space 14 can be a restricted physical space in itself, but in relation to this particular barrier 15, the accessible physical space 14 is accessible. In other words, the restricted first physical space 16 is inside the barrier 15 and the accessible physical space 14 is outside the physical barrier 15. In order to unlock the barrier 15, a first lock device 1 is provided. The first lock device 1 is controllable to be set in an unlocked state or locked state.

The first lock device 1 communicates with a mobile credential 2 over a wireless interface. The mobile credential 2 is any suitable device portable by a user and which can be used for authentication over the wireless interface. The mobile credential 2 is typically carried or worn by the user 7 and may be implemented as a mobile phone, a smartphone, a key fob, wearable device, smart phone case, etc. Using wireless communication, which uses any suitable wireless interface, e.g. using Bluetooth or Bluetooth Low Energy (BLE), ZigBee, any of the IEEE 802.11x standards (also known as WiFi), etc., the authenticity and authority of the mobile credential can be checked in an unlock procedure. Based on the result, the first lock device 1 grants or denies access. As described in more detail below, the access control procedure is managed based on the location of the mobile credential 2.

When access is granted, the first lock device 1 is set in an unlocked state. When the first lock device 1 is in an unlocked state, the barrier 15 can be opened and when the first lock device 1 is in a locked state, the barrier 15 cannot be opened. In this way, access to the inside 16 of the barrier 15 is controlled by the first lock device 1. It is to be noted that the first lock device 1 can be mounted in a surrounding structure 17 (e.g. wall) by the physical barrier 15 (as shown) or in the physical barrier 15 (not shown).

A barrier sensor 6 is optionally provided to detect the state of the barrier, e.g. when the barrier 15 is opened or closed.

Figure 2:
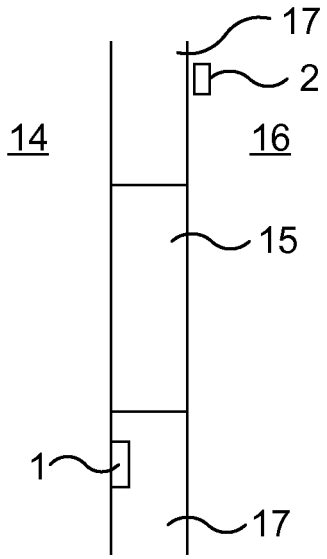
FIG. 2 is a schematic top view of the environment of FIG. 1. In this scenario, the mobile credential is located on the inside of the barrier, close to the surrounding structure.

FIG. 2 is a schematic top view of the environment of FIG. 1. In this scenario, the mobile credential 2 is located on the inside 16 of the barrier 15, close to the surrounding structure 17. In this situation, there is a small, albeit real, risk that the mobile credential 2 is erroneously considered to be on the outside 14, triggering an access control procedure which can result in the first lock device 1 being set in an unlocked state. Even when this risk is small, over time and over a large number of barriers 15, the risk is accumulated and can in this way become a significant security risk for a property.

Figure 3A:
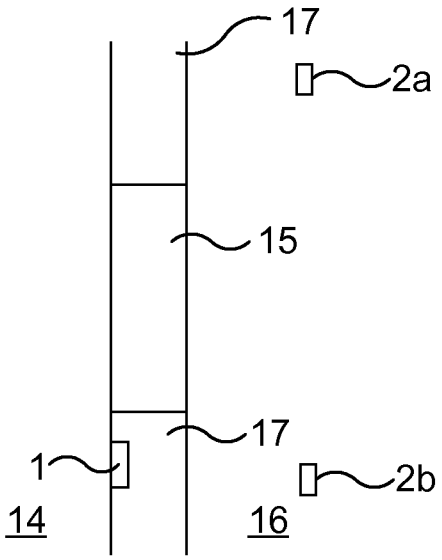
FIGS. 3A-B are schematic top views for the environment of FIG. 1 according to one embodiment where there are multiple mobile credentials.
Figure 3B:
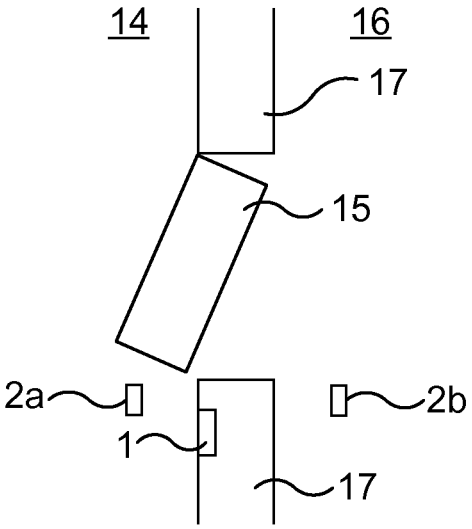

FIGS. 3A-B are schematic top views for the environment of FIG. 1 according to one embodiment where there are multiple mobile credentials.

Looking first to FIG. 3A, the two mobile credentials 2*a*, 2*b* are on the inside 16. In this embodiment, the first lock device 1 stores inside indicators for the two mobile credentials 2*a*, 2*b* in the form of a Mocking list containing identifiers of the mobile credentials 2*a*, 2*b*. When one of the mobile credentials 2*a*, 2*b* attempts to connect to the first lock device 1 for an access control procedure, the first lock device finds the identifier of the mobile credential in question on the blocking list and rejects to set up a communication channel.

Looking now to FIG. 3B, the first mobile credential 2*a* has exited and is now on the outside 14 of the barrier 15. In order to be responsive to any attempt of the first mobile credential 2*a* to re-enter, the first lock device 1 clears all inside indicators, i.e. for both mobile credentials 2*a*, 2*b*. In this way, the location determination does not need to be immediate to determine that the first mobile credential is on the outside if the access control procedure needs to be triggered to unlock the first lock device 1. Eventually, when the second mobile credential is determined to be on the inside, its identifier is again added to the blocking list.

Figure 4A:
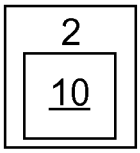
FIGS. 4A-C are schematic diagrams illustrating embodiments of where the access management device can be implemented.
Figure 4B:
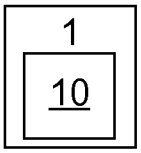
Figure 4C:
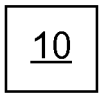

FIGS. 4A-C are schematic diagrams illustrating embodiments of where the access management device 10 can be implemented.

In FIG. 4A, the access management device 10 is shown as implemented in the mobile credential 2. The mobile credential 2 is thus the host device for the access management device 10 in this implementation.

In FIG. 4B, the access management device 10 is shown as implemented in the first lock device 1. The first lock device 1 is thus the host device for the access management device 10 in this implementation.

In FIG. 4C, the access management device 10 is shown as implemented as a stand-alone device. The access management device 10 thus does not have a host device in this implementation.

Figure 5:
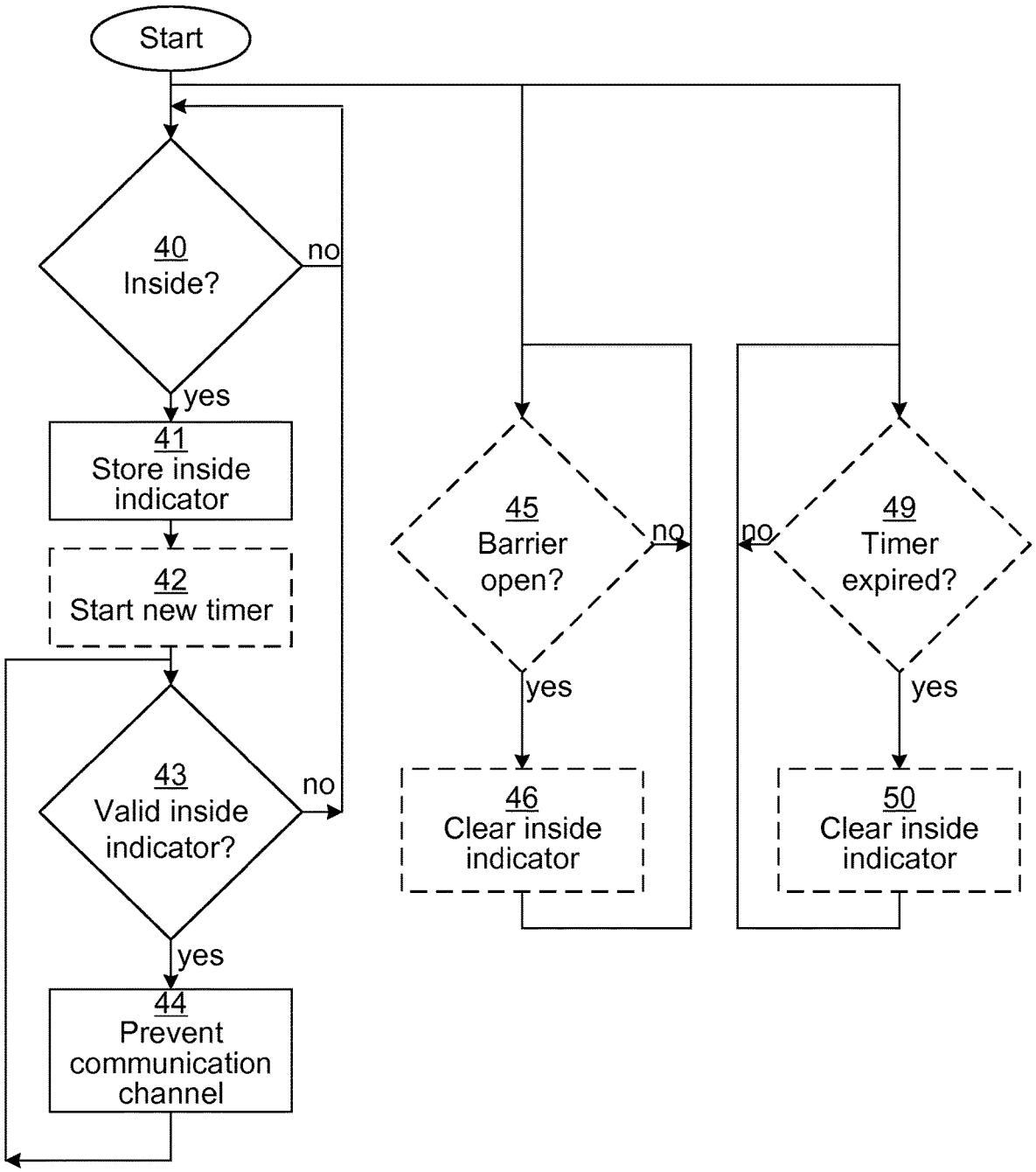
FIG. 5 is a flow chart illustrating embodiments of methods for managing access control to a physical space controlled by a lock device.

FIG. 5 is a flow chart illustrating embodiments of methods for managing access control to a physical space controlled by a first lock device, e.g. as shown in FIG. 1 above. The method is performed by an access management device.

In a conditional inside step 40, the access management device determines whether a mobile credential is located inside or outside a barrier secured by a lock device. The determination of inside or outside can be based on any suitable localisation procedure, e.g. angle of arrival, RSSI (Received Signal Strength Indicator), triangulation, etc., as known in the art per se. Significantly, the determination of inside or outside does not need to be extremely fast. For instance, by averaging the location of the mobile credential over many location measurements, the accuracy can be improved greatly when time is not of the highest importance.

In one embodiment, when the mobile credential is in the first physical space the mobile credential is considered to be inside a barrier secured by a lock device.

Figure 8:
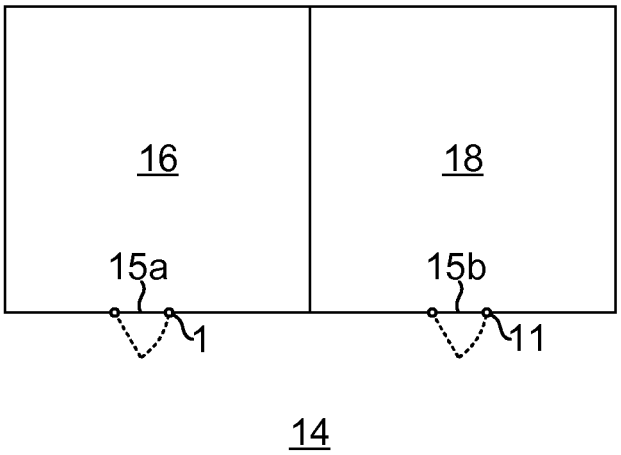
FIG. 8 is a schematic diagram illustrating a scenario where there are several corresponding physical spaces.

Looking now also to FIG. 8, one scenario will be described which is addressed in embodiments presented herein. There is the first physical space 16 (e.g. as shown in FIG. 1) as well as a second physical space 18. A first barrier 15*a* is provided to selectively allow entry to the first physical space 16 in cooperation with the first lock device 1. A second barrier 15*b* is provided to selectively allow entry to the physical space 18 in cooperation with a second lock device 11. The first physical space 16 and the second physical space are corresponding physical spaces. The first physical space 16 and the second physical space 18 can be neighbouring physical spaces. The physical spaces 16, 18 can be e.g. respective guest rooms in a hospitality environment. A guest room can e.g. be a hotel room in a hotel, a cabin on a cruise ship, etc. While this scenario shows two corresponding physical spaces, the principles described herein can be expanded to any number of corresponding physical spaces.

In order to support this scenario, in one embodiment, when the mobile credential is inside any of the corresponding physical spaces 16, 18, the mobile credential is considered to be located inside a barrier secured by a lock device. This can e.g. be a situation when a guest having a mobile credential for the first physical space is visiting someone in the (adjacent) second physical space, in which case the mobile credential may still be within range of the first lock 1. By being considered to be inside when in the second physical space, communication is prevented (see below for details), which reduces risk of inadvertent unlocking of the first lock device 1. Please note that the physical space 14 (e.g. a corridor or common space) being outside all of the barriers 15*a*, 15*b* is not considered to be located inside a barrier secured by a lock device.

In order to determine when the mobile credential is in the first physical space, the second physical space (or any other corresponding physical space), the access management device has access to a mapping between positions and the respective physical spaces.

If the mobile credential is located inside the barrier, the method proceeds to a store inside indicator step 41. Otherwise, this step is re-executed, optionally after a wait time.

In the store inside indicator step 41, the access management device stores an inside indicator in association with the mobile credential. The inside indicator is valid until explicitly cleared.

When the access management device is implemented in the mobile credential, the inside indicator can be a stored variable which is checked each time the mobile credential would set up communication with the lock device.

When the access management device is implemented in the lock device, the inside indicator can be in the form of a Mocking list containing identifiers of the mobile credential. In such a case, the blocking list can contain identifiers of multiple mobile credentials determined to be on the inside of the barrier.

In an optional start new timer step 42, the access management device starts a new timer. The timer is used to clear the inside indicator after a certain time, to ensure that a new determination of inside/outside (step 40) is re-executed. This determination is performed in steps 49 and 50, see below.

In a conditional valid inside indicator step 43, the access management device determines whether a valid inside indicator is stored for the mobile credential. When this step is performed right after step 41, this is almost always the case. If this is the case, the method proceeds to a prevent communication channel step 44. Otherwise, the method returns to the conditional inside step 49.

In a prevent communication channel step 44, the access management device prevents the mobile credential from establishing a communication channel with the lock device.

When the access management device forms part of the mobile credential, the mobile credential is prevented from sending any signal to the lock device. This can be done by checking the inside indicator in the form of a stored variable each time the mobile credential would set up communication with the lock device. This prevents any communication from occurring, saving energy in the mobile credential and reducing radio resource usage and interference for other wireless communication entities.

When the access management device forms part of the lock device, the preventing comprises rejecting any communication request from the mobile credential with the valid inside indicator, e.g. in the form of an entry on the blocking list.

In an optional conditional barrier open step 45, the access management device determines when the barrier is opened. The barrier can be determined to be opened by receiving a signal from a barrier sensor that the barrier has been opened. When the access management device is implemented in the mobile credential, this signal can e.g. be received over BLE. When the access management device lock device in the lock device, the sensor can form part of the lock device or it can be provided externally with a wired or wireless connection to the lock device. When several physical spaces are considered to represent the inside, this step evaluates the barrier of the physical space in which the mobile credential has been located. When the barrier is determined to be open, the method proceeds to an optional clear inside indicator step 46.

In an optional clear inside indicator step 46, the access management device clears the inside indicator for the mobile credential. The clearing of the inside indicator can be removal of the inside indicator, setting a validity indicator for the inside indicator to false, or setting an invalidity indicator for the inside indicator to true. When there are inside indicators for several mobile credentials, all inside indicators are cleared, e.g. as illustrated in FIGS. 3A-B and described above.

It is to be noted that steps 45 and 46 can be executed in a separate execution sequence (separate thread, process, etc.), from steps 40-44. Still, the clearing of the inside indicator in step 46 makes step 43 determine that there is no valid inside indicator.

In an optional conditional timer expired step 49, the access management device determines if the timer (started in step 42) has expired. If this is the case, the method proceeds to an optional clear inside indictor step 50. Otherwise, this step is re-executed.

In an optional clear inside indicator step 50, the access management device clears the inside indicator for the mobile credential. The clearing of the inside indicator can be removal of the inside indicator, setting a validity indicator for the inside indicator to false, or setting an invalidity indicator for the inside indicator to true. In this way, the clearing of the inside indicator in step 50 makes step 43 determine that there is no valid inside indicator. Also, the timer is reset in this step.

It is to be noted that steps 49-50 can be executed in a separate execution sequence (separate thread, process, etc.), from steps 40-44 as well as separately from optional steps 45 and 46 (when performed).

Using embodiments presented herein, the risk is reduced for access control procedures being triggered when a mobile credential is erroneously determined to be on the outside. Since the inside indicator is stored until it is explicitly cleared, communication between the mobile credential and the lock is avoided, and most opportunities for erroneously determined location are avoided. Additionally, power use is reduced both in the mobile credential and in the lock device, since most communication therebetween is eliminated.

By considering several corresponding physical spaces (respectively provided with lock devices) to represent inside space for a lock, a person visiting another physical space (e.g. another guest room) is still considered to be on the inside, whereby the communication and access control is then prevented to reduce the risk of inadvertent unlocking by the lock device communicating with the mobile credential.

Figure 6:
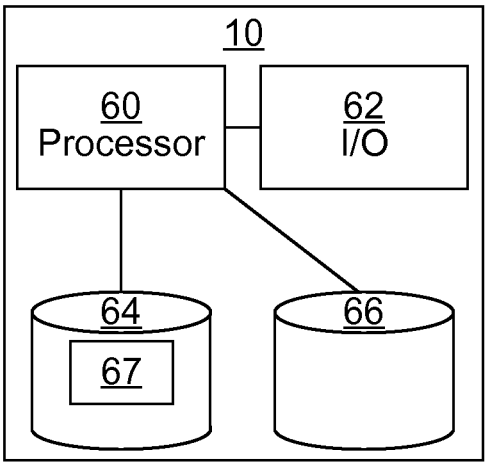
FIG. 6 is a schematic diagram illustrating components of the access management device of FIGS. 4A-C.

FIG. 6 is a schematic diagram illustrating components of the access management device 10 of FIGS. 4A-C. It is to be noted that one or more of the mentioned components can be shared with the host device. A processor 60 is provided using any combination of one or more of a suitable central processing unit (CPU), multiprocessor, microcontroller, digital signal processor (DSP), etc., capable of executing software instructions 67 stored in a memory 64, which can thus be a computer program product. The processor 60 could alternatively be implemented using an application specific integrated circuit (ASIC), field programmable gate array (FPGA), etc. The processor 60 can be configured to execute the method described with reference to FIG. 5 above.

The memory 64 can be any combination of random-access memory (RAM) and/or read only memory (ROM). The memory 64 also comprises persistent storage, which, for example, can be any single one or combination of magnetic memory, optical memory, solid-state memory or even remotely mounted memory.

A data memory 66 is also provided for reading and/or storing data during execution of software instructions in the processor 60. The data memory 66 can be any combination of RAM and/or ROM.

The access management device 10 further comprises an I/O interface 62 for communicating with external and/or internal entities. Optionally, the I/O interface 62 also includes a user interface.

Other components of the access management device 10 are omitted in order not to obscure the concepts presented herein.

Figure 7:
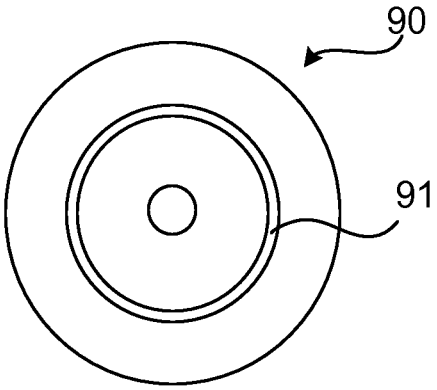
FIG. 7 shows one example of a computer program product comprising computer readable means.

FIG. 7 shows one example of a computer program product 90 comprising computer readable means. On this computer readable means, a computer program 91 can be stored, which computer program can cause a processor to execute a method according to embodiments described herein. In this example, the computer program product is an optical disc, such as a CD (compact disc) or a DVD (digital versatile disc) or a Blu-Ray disc. As explained above, the computer program product could also be embodied in a memory of a device, such as the computer program product 64 of FIG. 6. While the computer program 91 is here schematically shown as a track on the depicted optical disk, the computer program can be stored in any way which is suitable for the computer program product, such as a removable solid-state memory, e.g. a Universal Serial Bus (USB) drive.

Here now follows a list of embodiments from another perspective, enumerated with roman numerals.

i. A method for managing access control to a physical space controlled by a lock device, the method being performed by an access management device, and comprising the steps of:

determining whether a mobile credential is located inside or outside a barrier secured by the lock device;

storing an inside indicator in association with the mobile credential when it is located on the inside of the barrier, the inside indicator being valid until explicitly cleared; and preventing the mobile credential from establishing a communication channel with the lock device when a valid inside indicator is stored for the mobile credential.

ii. The method according to embodiment i, wherein the access management device forms part of the mobile credential, and wherein the step of preventing the mobile credential from establishing a communication channel comprises preventing the mobile credential from sending any signal to the lock device.

iii. The method according to embodiment i, wherein the access management device forms part of the lock device, and wherein the step of preventing the mobile credential from establishing a communication channel comprises rejecting any communication request from the mobile credential.

iv. The method according to any one of the preceding embodiments, further comprising the step of:

clearing the inside indicator for the mobile credential when the barrier is opened.

v. The method according to embodiment iv, wherein the barrier is determined to be opened by receiving a signal from a barrier sensor that the barrier has been opened.

vi. The method according to any one of the preceding embodiments, further comprising the step of:

clearing the inside indicator for the mobile credential when a timer expires.

vii. An access management device for managing access control to a physical space controlled by a lock device, the access management device comprising:

a processor; and a memory storing instructions that, when executed by the processor, cause the access management device to:

determine whether a mobile credential is located inside or outside a barrier secured by the lock device;

store an inside indicator in association with the mobile credential when it is located on the inside of the barrier, the inside indicator being valid until explicitly cleared; and prevent the mobile credential from establishing a communication channel with the lock device when a valid inside indicator is stored for the mobile credential.

viii. The access management device according to embodiment vii, wherein the access management device forms part of the mobile credential, and wherein the instructions to prevent the mobile credential from establishing a communication channel comprise instructions that, when executed by the processor, cause the access management device to prevent the mobile credential from sending any signal to the lock device.

ix. The access management device according to embodiment vii, wherein the access management device forms part of the lock device, and wherein the instructions to prevent the mobile credential from establishing a communication channel comprise instructions that, when executed by the processor, cause the access management device to reject any communication request from the mobile credential.

x. The access management device according to any one of embodiments vii to ix, further comprising instructions that, when executed by the processor, cause the access management device to:

clear the inside indicator for the mobile credential when the barrier is opened.

xi. The access management device according to embodiment x, wherein the barrier is determined to be opened by receiving a signal from a barrier sensor that the barrier has been opened.

xii. The access management device according to any one of embodiments vii to xi, further comprising instructions that, when executed by the processor, cause the access management device to:

clear the inside indicator for the mobile credential when a timer expires.

xiii. A computer program for managing access control to a physical space controlled by a lock device, the computer program comprising computer program code which, when run on an access management device causes the access management device to:

determine whether a mobile credential is located inside or outside a barrier secured by the lock device;

store an inside indicator in association with the mobile credential when it is located on the inside of the barrier, the inside indicator being valid until explicitly cleared; and prevent the mobile credential from establishing a communication channel with the lock device when a valid inside indicator is stored for the mobile credential.

xiv. A computer program product comprising a computer program according to embodiment xiii and a computer readable means on which the computer program is stored.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A method for managing access control to a first physical space controlled by a first lock device, the method being performed by an access management device, and comprising:

determining whether a mobile credential is located inside or outside a barrier secured by a lock device, which comprises considering the mobile credential to be inside when the mobile credential is in the first physical space as well as when the mobile credential is in a second physical space secured by a second lock device, wherein the second physical space is adjacent to the first physical space;

storing an inside indicator in association with the mobile credential when it is located on the inside of the barrier, the inside indicator being valid until explicitly cleared; and preventing the mobile credential from establishing a communication channel with the first lock device when a valid inside indicator is stored for the mobile credential.

2. The method according to claim 1, wherein the access management device forms part of the mobile credential, and wherein preventing the mobile credential from establishing a communication channel comprises preventing the mobile credential from sending any signal to the first lock device.

3. The method according to claim 1, wherein the access management device forms part of the first lock device, and wherein preventing the mobile credential from establishing a communication channel comprises rejecting any communication request from the mobile credential.

4. The method according to claim 1, further comprising:

clearing the inside indicator for the mobile credential when the barrier is opened.

5. The method according to claim 4, wherein the barrier is determined to be opened by receiving a signal from a barrier sensor that the barrier has been opened.

6. The method according to claim 1, further comprising:

clearing the inside indicator for the mobile credential when a timer expires.

7. The method according to claim 1, wherein determining whether the mobile credential is located inside or outside comprises considering the mobile credential to be inside when the mobile credential is in the first physical space.

8. The method according to claim 1, wherein the first physical space is a first guest room and the second physical space is a second guest room.

9. An access management device for managing access control to a first physical space controlled by a first lock device, the access management device comprising:

a processor; and a memory storing instructions that, when executed by the processor, cause the access management device to:

determine whether a mobile credential is located inside or outside a barrier secured by a lock device, which comprises to consider the mobile credential to be inside when the mobile credential is in the first physical space as well as when the mobile credential is in a second physical space secured by a second lock device, wherein the second physical space is adjacent to the first physical space;

store an inside indicator in association with the mobile credential when it is located on the inside of the barrier, the inside indicator being valid until explicitly cleared; and prevent the mobile credential from establishing a communication channel with the first lock device when a valid inside indicator is stored for the mobile credential.

10. The access management device according to claim 9, wherein the access management device is configured to form part of the mobile credential, and wherein the instructions to prevent the mobile credential from establishing a communication channel comprise instructions that, when executed by the processor, cause the access management device to prevent the mobile credential from sending any signal to the first lock device.

11. The access management device according to claim 9, wherein the access management device is configured to form part of the first lock device, and wherein the instructions to prevent the mobile credential from establishing a communication channel comprise instructions that, when executed by the processor, cause the access management device to reject any communication request from the mobile credential.

12. The access management device according to claim 9, further comprising instructions that, when executed by the processor, cause the access management device to:

clear the inside indicator for the mobile credential when the barrier is opened.

13. The access management device according to claim 12, wherein the barrier is determined to be opened by receiving a signal from a barrier sensor that the barrier has been opened.

14. The access management device according to claim 9, further comprising instructions that, when executed by the processor, cause the access management device to:

clear the inside indicator for the mobile credential when a timer expires.

15. The access management device according to claim 9, wherein the instructions to determine whether the mobile credential is located inside or outside comprise instructions that, when executed by the processor, cause the access management device to consider the mobile credential to be inside when the mobile credential is in the first physical space.

16. The access management device according to claim 9, wherein the first physical space is a first guest room and the second physical space is a second guest room.

17. A non-transitory computer-readable medium comprising a computer program stored thereon for managing access control to a first physical space controlled by a first lock device, the computer program comprising computer program code which, when run on an access management device causes the access management device to:

determine whether a mobile credential is located inside or outside a barrier secured by a lock device, which comprises to consider the mobile credential to be inside when the mobile credential is in the first physical space as well as when the mobile credential is in a second physical space secured by a second lock device, wherein the second physical space is adjacent to the first physical space;

store an inside indicator in association with the mobile credential when it is located on the inside of the barrier, the inside indicator being valid until explicitly cleared; and prevent the mobile credential from establishing a communication channel with the first lock device when a valid inside indicator is stored for the mobile credential.

* * * * *